US011064831B1

(12) United States Patent
Biddle

(10) Patent No.: US 11,064,831 B1
(45) Date of Patent: Jul. 20, 2021

(54) PACKAGE DELIVERY SYSTEM AND METHOD OF USE

(71) Applicant: LaTonya M. Biddle, Allen, TX (US)

(72) Inventor: LaTonya M. Biddle, Allen, TX (US)

( * ) Notice: Subject to any disclaimer, the term of this patent is extended or adjusted under 35 U.S.C. 154(b) by 0 days.

(21) Appl. No.: 16/549,793

(22) Filed: Aug. 23, 2019

Related U.S. Application Data

(60) Provisional application No. 62/722,559, filed on Aug. 24, 2018.

(51) Int. Cl.
*A47G 29/124* (2006.01)
*A47G 29/22* (2006.01)

(52) U.S. Cl.
CPC ..... *A47G 29/124* (2013.01); *A47G 29/22* (2013.01); *A47G 2029/1257* (2017.08)

(58) Field of Classification Search
CPC ..... A47G 29/124; A47G 29/1248; A47G 29/12095; A47G 29/14; A47G 29/16; A47G 29/20; A47G 29/141; A47G 29/1216; A47G 2029/1257; A47G 2029/148; A47G 29/22
USPC ..... 232/17, 19, 39, 45, 47, 48, 54, 1 E, 63
See application file for complete search history.

(56) References Cited

U.S. PATENT DOCUMENTS 459,386 A * 9/1891 Libbey ..... A47G 29/1225 232/36
722,323 A * 3/1903 Parker ..... A47G 29/1216 232/54
4,694,668 A * 9/1987 Ciletti ..... A47G 29/20 109/50
4,909,052 A * 3/1990 Hutwohl ..... A47G 29/20 109/50
5,027,948 A * 7/1991 Forbes ..... G11B 23/023 206/387.11
5,624,071 A * 4/1997 Sosan ..... A47G 29/20 232/1 B
6,155,715 A * 12/2000 Lake ..... A47G 29/20 150/102
6,330,816 B1 * 12/2001 O'Connor ..... E05B 19/0005 109/50
6,588,656 B2 * 7/2003 Cox ..... A47G 29/16 232/47
6,840,438 B2 * 1/2005 Hassan ..... A47G 29/1216 232/39
7,036,719 B1 * 5/2006 Helphrey ..... A47G 29/1209 232/47
7,249,705 B2 * 7/2007 Dudley ..... A47G 29/141 232/45
7,854,374 B2 * 12/2010 Dudley ..... A47G 29/12095 232/45
D644,814 S * 9/2011 Clarke ..... D99/33
(Continued)

*Primary Examiner* — William L Miller
(74) *Attorney, Agent, or Firm* — Leavitt Eldredge Law Firm

(57) ABSTRACT

A package delivery system includes a delivery pod container having a package deposit door positioned at a top of the delivery pod container, the package deposit door providing access to an interior area of the delivery pod container; and a pod door located on a front of the delivery pod container and to provide access to the interior area of the delivery pod container, the pod door having a lock; a bracket attached to the delivery pod container and to engage with a door and mount the delivery pod container thereto; the delivery pod container is to receive the package therein upon delivery from the delivery personnel.

3 Claims, 7 Drawing Sheets

(56) References Cited

U.S. PATENT DOCUMENTS

| | | | | |
|---|---|---|---|---|
| 8,336,760 | B2 * | 12/2012 | Skouboe | A47G 29/22<br>232/48 |
| 10,321,780 | B1 * | 6/2019 | James | A47G 23/06 |
| 10,368,676 | B1 * | 8/2019 | Ansari | A47G 29/1251 |
| 10,383,471 | B1 * | 8/2019 | Barnes | A47G 29/20 |
| 10,512,352 | B1 * | 12/2019 | Torres | A47G 29/22 |
| 10,537,196 | B1 * | 1/2020 | MacPherson | A47G 29/20 |
| 10,537,197 | B2 * | 1/2020 | Hopp | A47G 29/20 |
| 2005/0193931 | A1 * | 9/2005 | Boudreau | E05G 1/005<br>109/50 |
| 2016/0051073 | A1 * | 2/2016 | Heinz | A47G 29/141<br>232/39 |
| 2016/0068306 | A1 * | 3/2016 | Heinz | B65D 81/02<br>220/560.01 |
| 2016/0309939 | A1 * | 10/2016 | Mencel | A47G 29/20 |
| 2017/0127868 | A1 * | 5/2017 | Adewuyi | A47G 29/141 |
| 2017/0188737 | A1 * | 7/2017 | Hippert | A47G 29/20 |
| 2019/0256119 | A1 * | 8/2019 | Brilhante | A47G 29/124 |
| 2019/0350398 | A1 * | 11/2019 | Raphael | A47G 29/141 |

* cited by examiner

PACKAGE DELIVERY SYSTEM AND METHOD OF USE

BACKGROUND

1. Field of the Invention

The present invention relates generally to a package delivery system and methods of use. More specifically, the invention is related to a system and method to secure packages delivered to a home and protect those packages from theft.

2. Description of Related Art

Systems and methods for delivering packages is well known in the art. Many consumers opt for online shopping and personal home or office delivery, wherein online manufacturers and distributors utilize delivery companies to deliver packages that have been ordered. Orders are processed and packages sent out from general location warehouses. From the warehouse, the package is then hand delivered to a consumer's door. Oftentimes, the delivery worker finds the consumer is not at home and must leave the package unattended at the door step at which point the package will be retrieved by the customer when he or she arrives at home.

One of the problems commonly associated with process 101 is the limited use. For example, when a package 105 is left unattended for long periods of time at the household door 103 and the customer cannot go to the house 107 to retrieve it, there is increased risk of the package being stolen. Alternatively, the delivery worker at times must deliver the package to the person directly, with a signature of reception. Thus, the delivery worker must keep coming back to the house until the customer is home to receive the package in person. This results in extra labor for the delivery company and the customer does not receive the package in a timely manner or must adjust his or her schedule to be home when the delivery arrives. Additionally, even if the package is not stolen, confidential consumer information like full name, address and other identifiers are left unprotected out in the open. Adverse weather such as wind, snow and rain can negatively impact the package outer covering and at times, damage the contents of the package.

Although great strides have been made in the area of package delivery systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
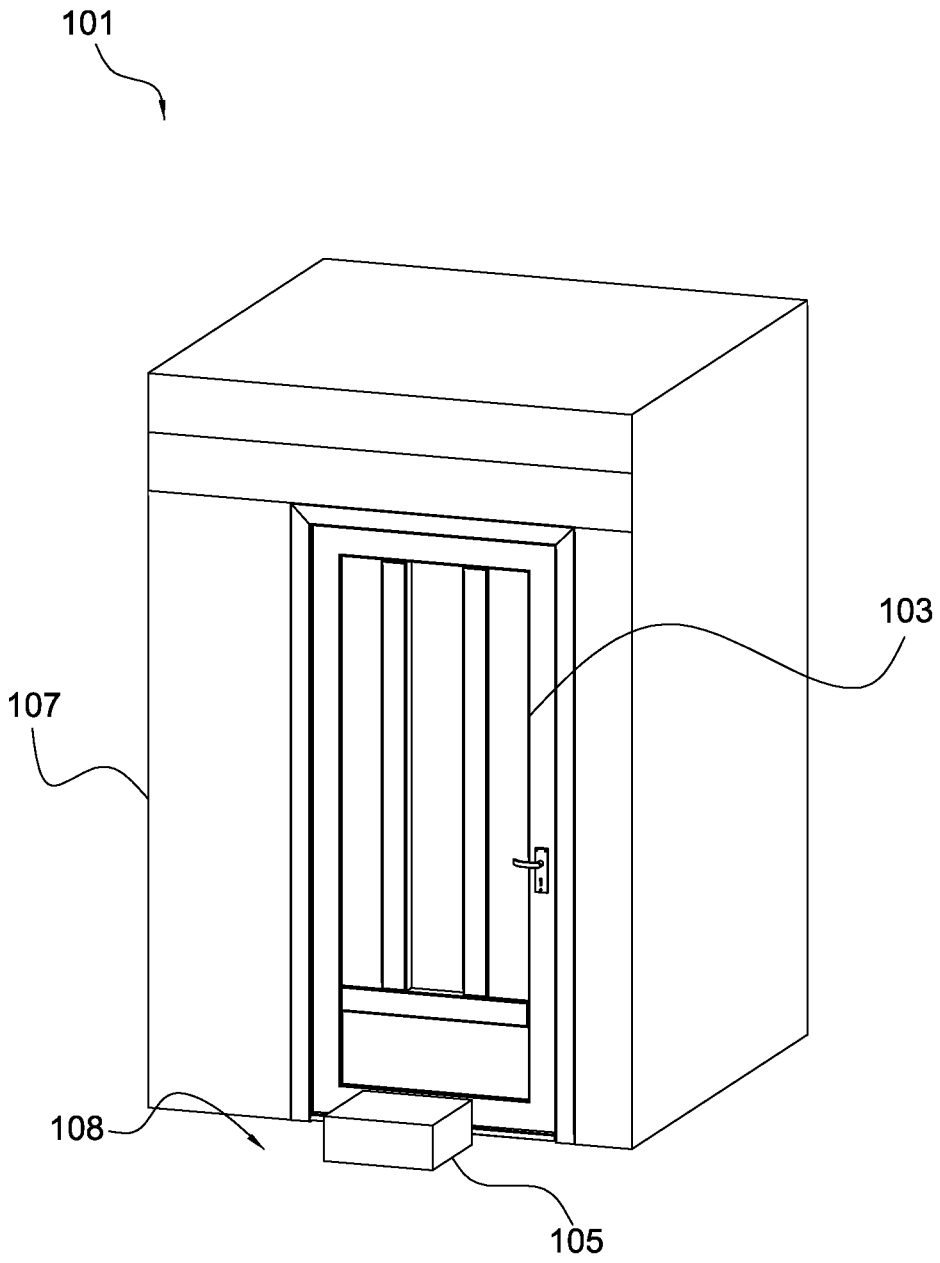
FIG. 1 (PRIOR ART)
FIG. 1 is a simplified schematic of a conventional process of ordering packages online for home delivery.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods to deliver and store packages. Specifically, the present invention is directed to a delivery pod container 205 configured to receive packages wherein the delivery pod container 205 is secured to a door to prevent the delivery pod container 205 from being removed from a house 107. This system ultimately protects the packages inside the delivery pod container 205 from theft. It should be appreciated that the entire pod is secured to door of the house, via one or more brackets, in order to prevent theft of the entire system. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3A:
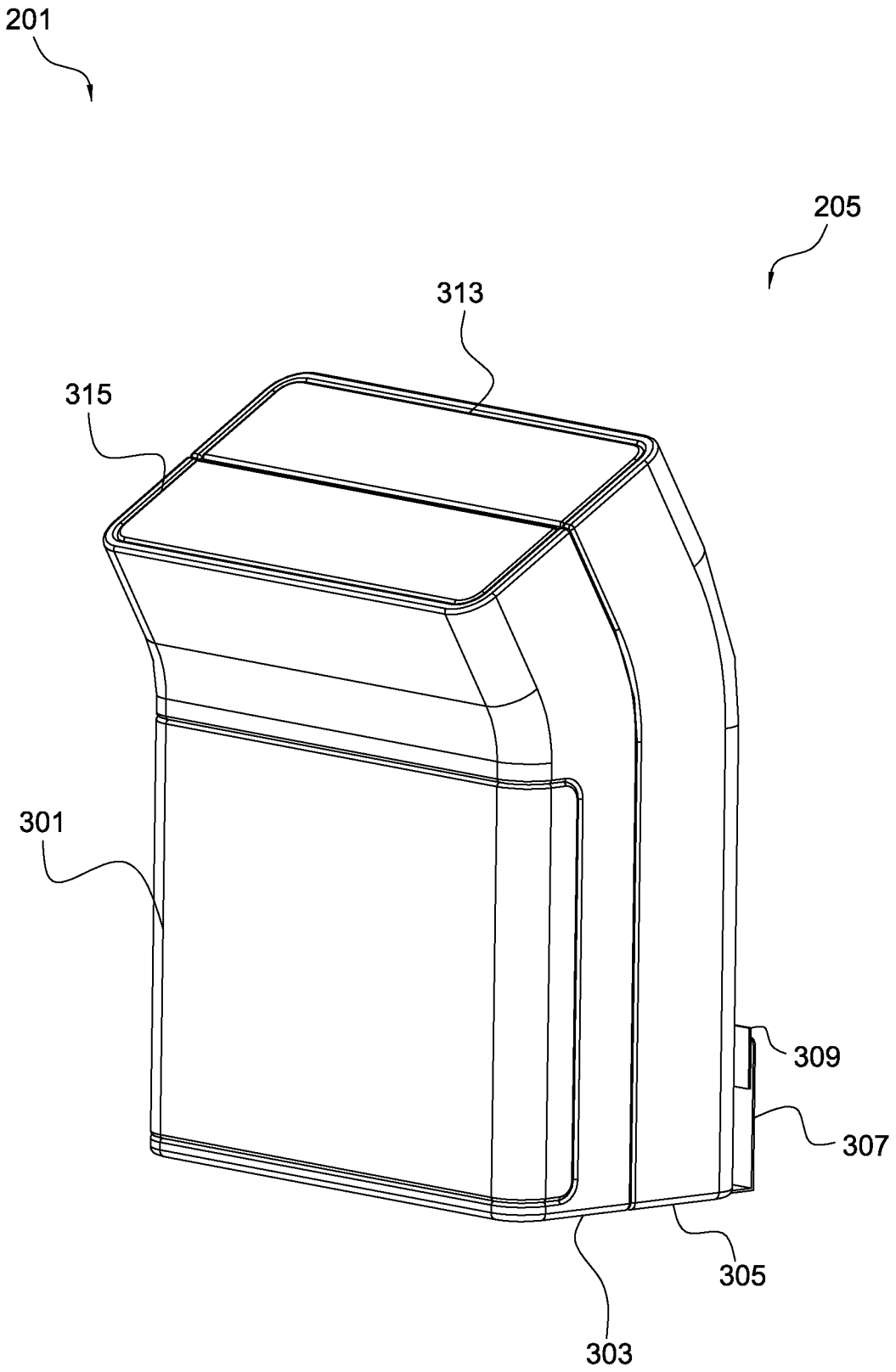
FIG. 3A is an oblique view of the delivery pod container of the system of FIG. 2A.
Figure 3B:
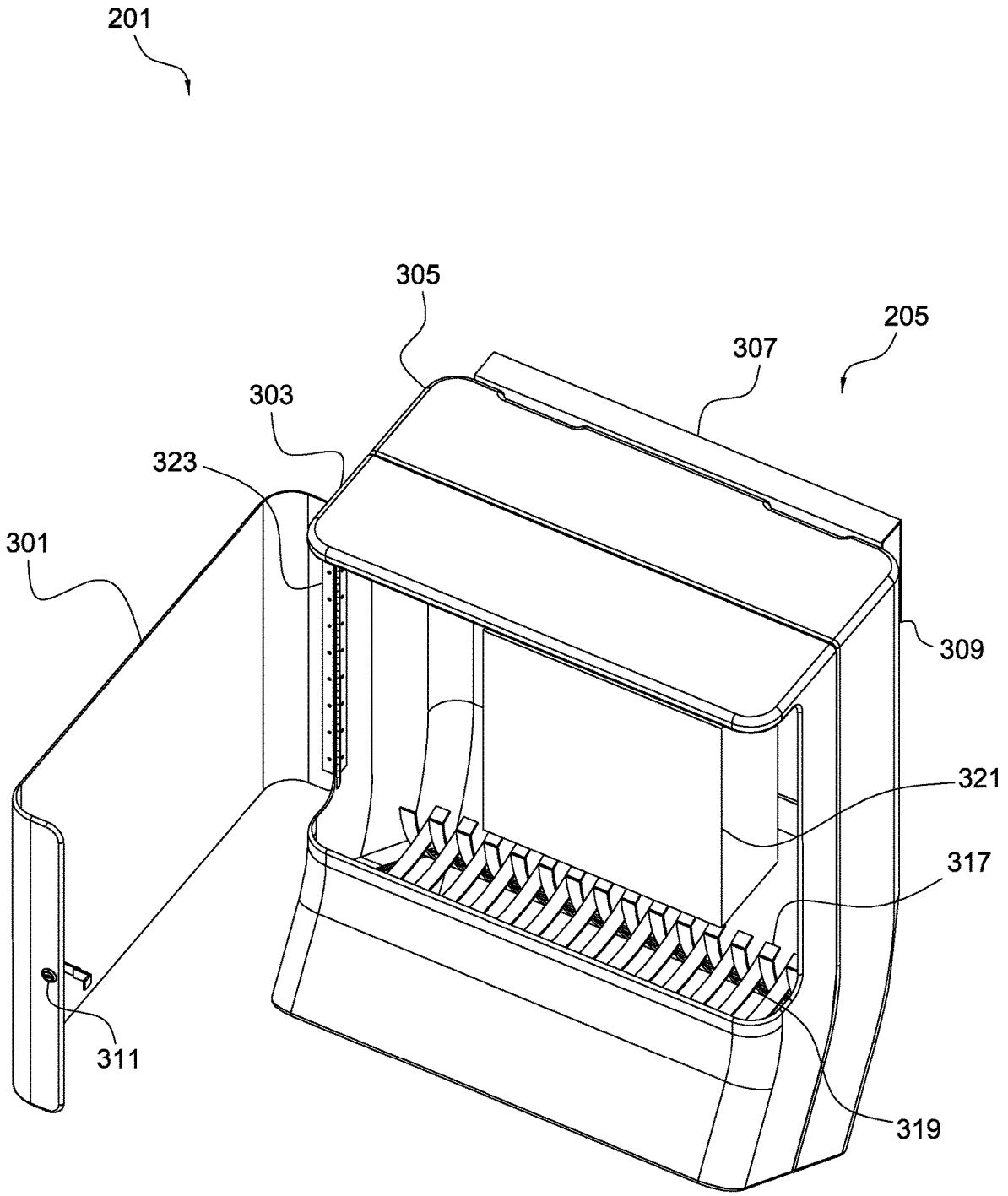
FIG. 3B is an oblique view of the inside of the delivery pod container of the system of FIG. 2A.
Figure 3C:
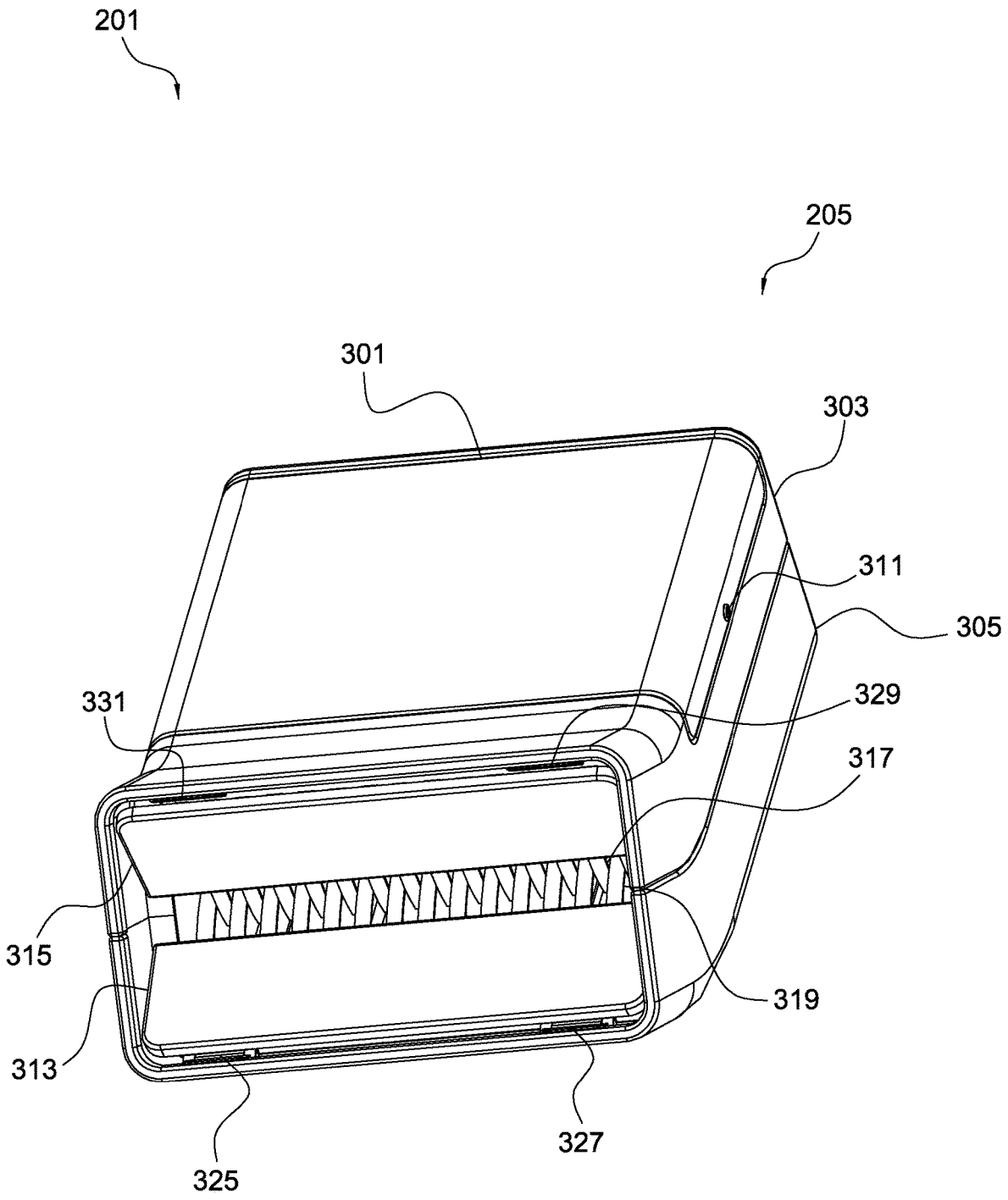
FIG. 3C is a bottom view of the delivery pod container of the system of FIG. 2A.
Figure 4:
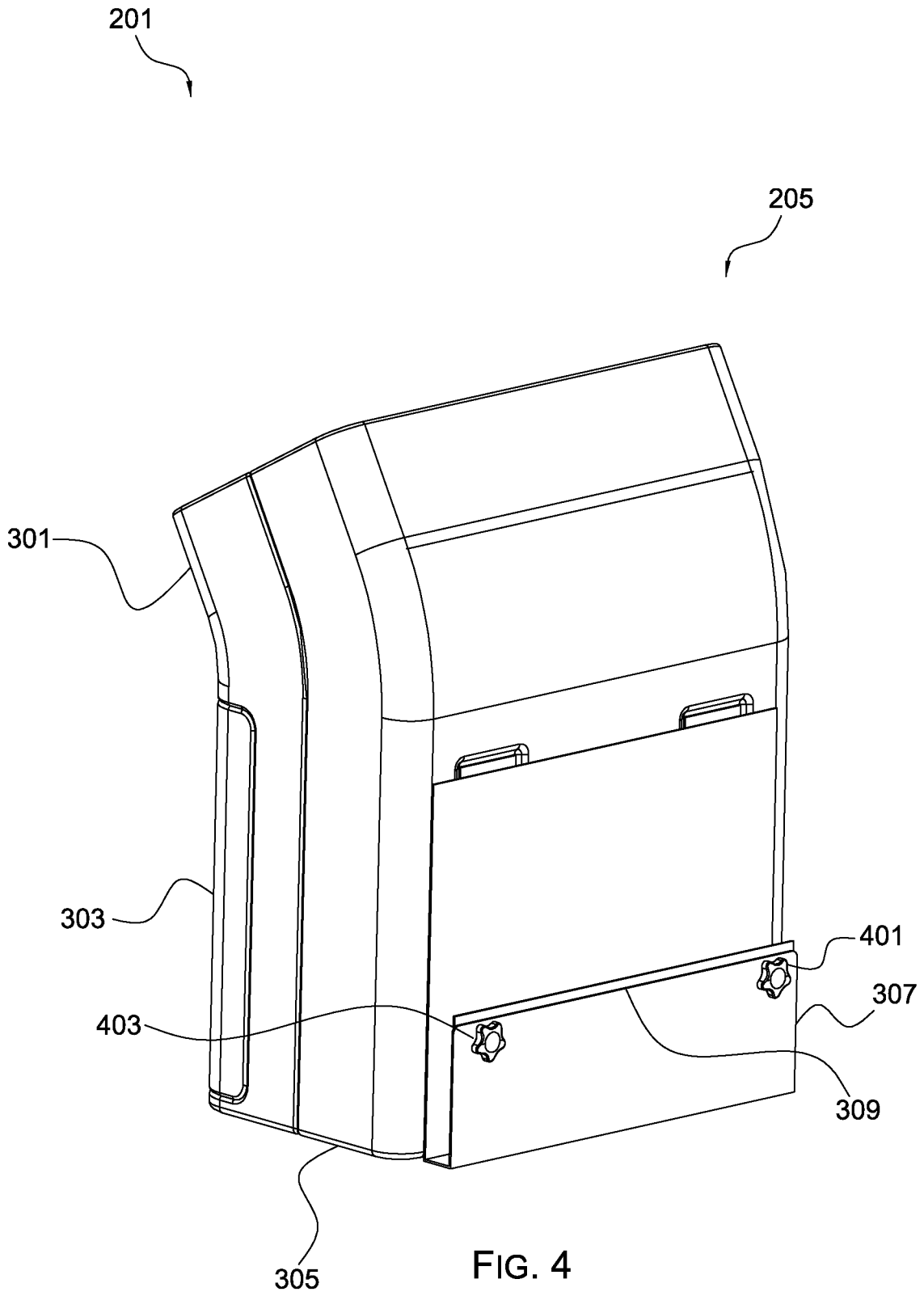
FIG. 4 is a back view of the delivery pod container of the system of FIG. 2A.

Referring now to the drawings wherein like reference characters identify corresponding or similar elements throughout the several views, FIGS. 2-4 depict various views of a system 201 and method of use in accordance with a preferred embodiment of the present application. It will be appreciated that system 201 overcomes one or more of the above-listed problems commonly associated with the conventional systems and methods to deliver packages.

System 201 is contemplated utilizing a delivery pod container 205 configured to overcome the problems commonly associated with conventional delivering processes.

Figure 2A:
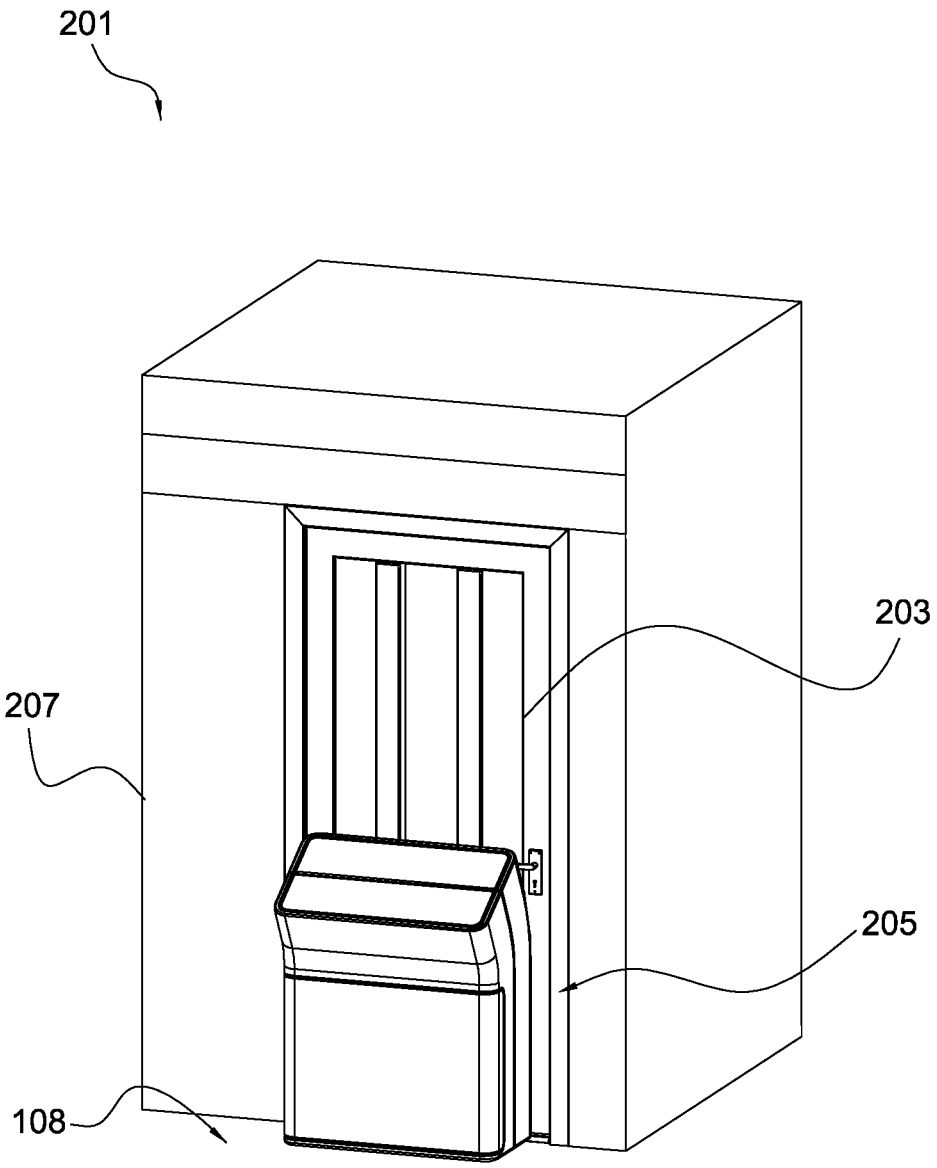
FIG. 2A is a simplified schematic of a system of the present invention in accordance with the preferred embodiment of the present invention.
Figure 2B:
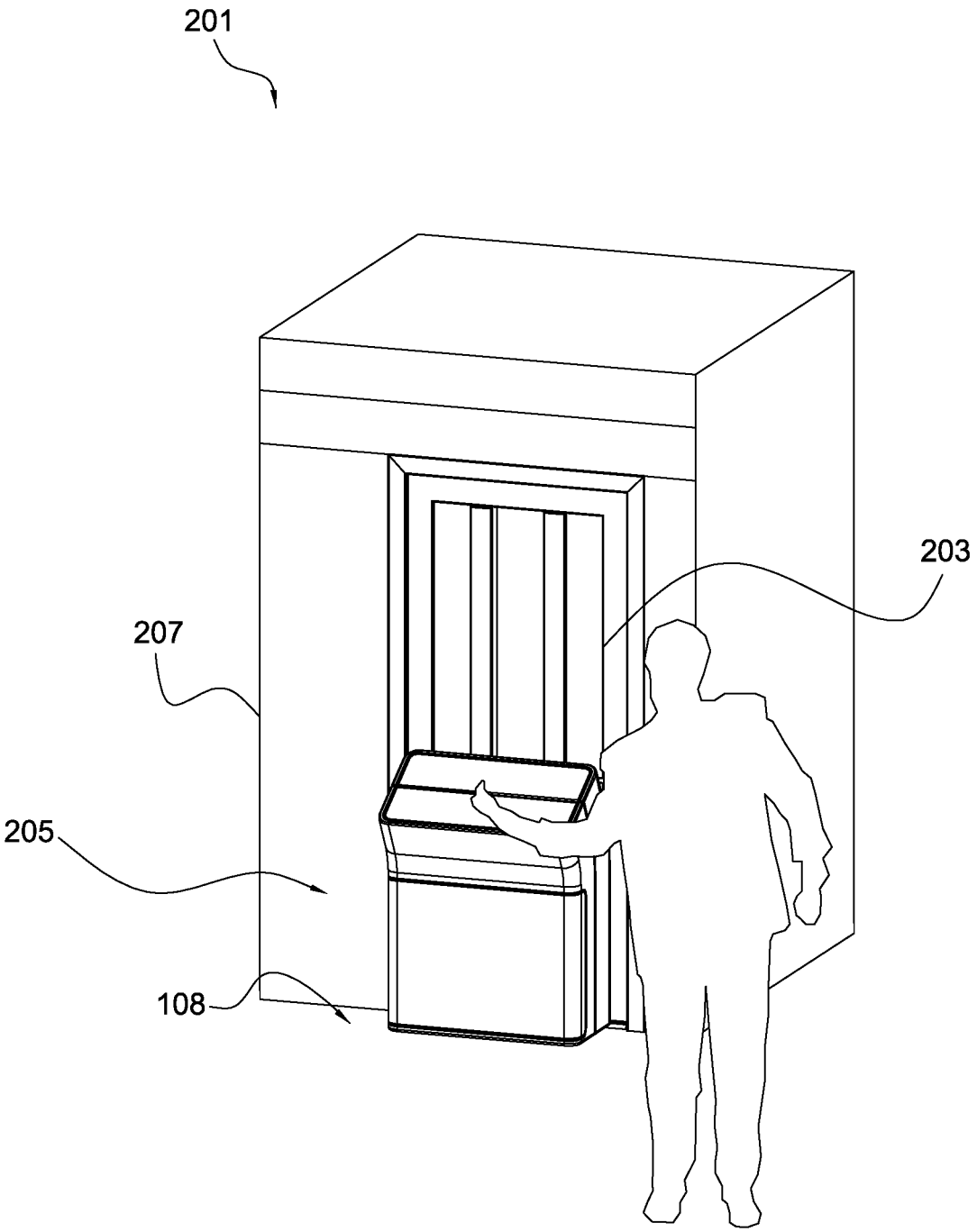
FIG. 2B is a simplified schematic of a process associated with the present invention in accordance with the preferred embodiment of the present invention.

Referring to FIG. 2A, a conventional door 203 of a house 207 is shown having a secured delivery pod container 205 attached to the front of the door. FIG. 2B is a depiction of the manner in which a delivery worker 209 can easily and efficiently place a package through the package deposit door located at the top of the delivery pod container 205 through the angled neck, wherein the package is deposited safely within an interior area of the delivery pod container. In the preferred embodiment, the delivery pod container 205 is attached at the bottom of the door and resides on the porch 108 of the house 107 or area in front of the door.

Referring now to FIG. 3A, the delivery pod container 205 is shown in greater detail. The delivery pod container 205 is configured as a portable secured structure configured to store packages. The delivery pod container 205 is shown having a pod door 301 located on the front of the delivery pod container 205. A key hole lock 311 is shown on the side of the pod door 301 and is configured to remain locked unless the key is used to open the door. The delivery pod container 205 is rectangular shaped with a sloped compartment at the top through which a package can be inserted into the delivery pod container 205. The package deposit door located at the top of the delivery pod is configured as two rigid flaps 313, 315 that are configured to rotate inward and upward inside the delivery pod container 205 as a package is pushed downward through the slanted portion of the delivery pod container 205. This portion of the delivery pod container 205 is referred to as the neck and is angled such that the delivery worker can easily and quickly place the package inside the delivery pod container 205 so as not to disrupt the speed at which the delivery person needs to be able to drop the package. This feature is referred to as the "drop and go" aspect of the delivery pod container 205.

The system 201 in FIG. 3A is also shown having a security door bracket 309 attached to the backside 307 of the delivery pod container 205. During assembly of the delivery pod container 205, after the security door bracket 309 is mounted to the delivery pod container 205, the security door bracket 309 is fastened and tightened into place by two turn knobs that can only be accessed through the key-locked front pod door 301. The security door bracket 309 is an "L-shaped" bracket. The security door bracket 309 is configured to attach to the door of the house by sliding the delivery pod container 205 onto an open door. The security door bracket 309 is then fastened and tightened onto door via two outside turn knobs. The door is then closed and locked without the addition of the security door bracket 309 inhibiting the closing or locking of the door. With the delivery pod container 205 now securely fastened to the closed door, the delivery pod container 205 cannot be removed from the door, thus protecting its contents from theft.

Referring now to FIG. 3B, the delivery pod container 205 is shown with the front pod door 301 open to expose the inside cavity of the delivery pod container 205. The front pod door 301 is shown being attached to the body of the delivery pod container 205 via a hinge 323 that allows the pod door 301 is rotate outward to retrieve the package inside. The delivery pod container 205 is also shown having one-way prevention teeth 317, 319 which are two sets of a series of upwardly angled rods that are crossed with one another. The one-way prevention teeth 319 are configured to allow the package to be pushed through the top flaps 313,315 which form the package deposit door located at the end of the delivery pod container 205 housing the angled neck, by having each opposing set of rods expand outward, thus clearing the path into the cavity of the delivery pod container 205. The one-way prevention teeth over molded metal prongs allow packages to pass through them while making it challenging to extract the packages through the package deposit door. When the package is placed inside, the one-way prevention teeth 317, 319 close back together wherein the rods interlock to create a barrier between the package and the drop and go portion of the delivery pod container 205. If a thief were to try to remove a package from the delivery pod container 205 by pushing their hand through the flaps 313,315, the one-way prevention teeth 317, 319 would not open wide enough to remove the package when the package would be pulled back out of the delivery pod container 205. In one embodiment, the two sets of one-way prevention teeth 317, 319 would be spring loaded, such that the automatic position of the teeth would be closed and interlocked. The movement of the hand pulling the package would cause the teeth to spring back together.

Referring now to FIG. 3C, the delivery pod container 205 is shown having the two rigid bottom flaps 315, 313 forming the package deposit door wherein upon pressure the flaps rotate inward, thus causing the one-way prevention teeth 317, 319 to separate and clear a path for the package to be placed inside the delivery pod container 205.

Referring now to FIG. 4, the backside of the delivery pod container 205 is shown having a security door bracket 309. The bracket is attached to the back panel of the delivery pod container 205 and is configured to wrap around a conventional door. The bracket 309 is shown having two bolts 401, 403 which can be used to bolt the security bracket onto the door.

In the preferred embodiment, the delivery pod container 205 is attached to the bottom of the door via the security door bracket 309 and packages are pushed downward through the drop and go compartment. The angled neck structure of the package deposit door is configured to accommodate the speed at which the delivery person must deliver packages so as to meet the established quotas for delivery quantities and times. In an alternate embodiment, the delivery pod container 205 is attached at the top of the door and packages are pushed upward into the cavity of the delivery pod container 205 through the flaps 313,315.

The system 201 relates to a method for delivering packages. First, a delivery pod container 205 as described above is provided to the customer or resident. The delivery pod is attached to the main delivery door via the security door bracket 309. The customer places an order of a package for home delivery. A delivery person arrives at the home to deliver the package by placing the package inside the delivery pod container 205. While the package is being stored in the delivery pod container 205, the keylock on the pod door and the one-way prevention teeth 317, 319, and security door bracket 309 prevent a thief from stealing the package before the customer can get the package. When the customer needs to retrieve his or her package, the customer will be able to open the pod door 301 via the keyhole and easily obtain the package.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A package delivery system, comprising:

a delivery pod container configured to secure a package, the delivery pod container having:

a body with a front wall and a back wall, the body having a rectangular shape and being sloped at a top portion, such that the top portion is angled up and away from a ground surface when secured to a door;

a package deposit door having a first flap and a second flap each configured to rotate inward, the package deposit positioned at a top of the delivery pod container, the package deposit door providing access to an interior area of the delivery pod container;

a pod door located on the front wall of the delivery pod container and configured to provide access to the interior area of the delivery pod container, the pod door having a lock;

a L-shaped bracket attached to and extending from the back wall of the delivery pod container opposite the package deposit door and configured to engage with the door, the L-shaped bracket is configured to secure the body to the door while the body rests on the ground surface in front of the door; and a plurality of one-way prevention teeth positioned directly below the package deposit door and within the interior area, the plurality of one-way prevention teeth are a first plurality of rods and a second plurality of rods inter-crossed with each other directly below the package deposit door, the first plurality of rods being attached to the front wall of the body and the second plurality of rods being attached to the back wall of the body, the plurality of one-way prevention teeth are configured to separate when pressed by the flaps and allow the package to pass through the plurality of rods to enter the interior area;

wherein the delivery pod container is configured to receive the package therein upon delivery from the delivery personnel.

2. The system of claim 1, wherein the bracket includes one or more turn knobs configured to tighten against the door.

3. A method of package delivery, the method comprising:

providing the system of claim 1;

securing the delivery pod container to the door via the bracket;

dropping the package within the delivery pod container through the package deposit door; and retrieving the package through the pod door.

* * * * *